US007727362B2

(12) United States Patent
Bytyn

(10) Patent No.: US 7,727,362 B2
(45) Date of Patent: Jun. 1, 2010

(54) SACRIFICIAL ANODE FOR CATHODIC CORROSION PROTECTION

(75) Inventor: Wilfried Bytyn, Bochum (DE)

(73) Assignee: Magontec GmbH, Bottrop (DE)

( * ) Notice: Subject to any disclaimer, the term of this patent is extended or adjusted under 35 U.S.C. 154(b) by 424 days.

(21) Appl. No.: 11/807,418

(22) Filed: May 29, 2007

(65) Prior Publication Data

US 2007/0272544 A1 Nov. 29, 2007

(30) Foreign Application Priority Data

May 29, 2006 (DE) ..... 10 2006 025 252

(51) Int. Cl.
*C23F 13/16* (2006.01)

(52) U.S. Cl. ..... 204/196.17; 204/196.24; 204/196.3; 204/280; 204/286.1; 204/288.4

(58) Field of Classification Search ..... 204/196.01, 204/196.07, 196.11, 196.18, 196.19, 196.22, 204/196.23, 196.24, 196.25, 196.26, 196.31, 204/196.32, 196.37

See application file for complete search history.

(56) References Cited

U.S. PATENT DOCUMENTS

| | | | | |
|---|---|---|---|---|
| 3,867,274 | A * | 2/1975 | Herman | 204/196.16 |
| 4,035,903 | A * | 7/1977 | Taggart | 29/458 |
| 4,060,472 | A * | 11/1977 | Alewitz | 204/196.16 |
| 4,093,529 | A * | 6/1978 | Strobach | 204/196.11 |
| 4,224,126 | A * | 9/1980 | Bidwell | 204/196.19 |
| 4,786,383 | A * | 11/1988 | Houle | 205/731 |
| 5,256,267 | A * | 10/1993 | Roden | 204/196.11 |
| 5,334,299 | A * | 8/1994 | Roden | 204/196.11 |
| 5,335,311 | A * | 8/1994 | Groothuizen | 204/196.11 |
| 6,606,452 | B1 * | 8/2003 | Caine | 392/457 |
| 7,017,251 | B1 * | 3/2006 | Murphy | 29/458 |
| 7,387,713 | B2 * | 6/2008 | Marcelino et al. | 204/196.11 |
| 2008/0190919 | A1 * | 8/2008 | Kahite et al. | 220/4.12 |

FOREIGN PATENT DOCUMENTS

| | | |
|---|---|---|
| CH | 424 420 | 11/1996 |
| DE | 1 936 784 | 4/1966 |
| DE | 69 08 831 | 2/1969 |

* cited by examiner

*Primary Examiner*—Bruce F Bell
(74) *Attorney, Agent, or Firm*—Woodard, Emhardt, Moriarty, McNett & Henry LLP

(57) ABSTRACT

The invention pertains to a sacrificial anode for cathodic corrosion protection that comprises an anode body (1), a mounting component (8) for mounting the sacrificial anode on the device to be protected, an insulating component (4) that in certain areas surrounds the anode body (1) and electrically insulates the anode body (1) from the mounting component (8), and a resistive element (9) that is inserted between the anode body (1) and the mounting component (8), where the insulating component (4) is fixed on the mounting component (8). According to the disclosure, a securing component (6) is fixed on the anode body (1) and prevents the anode body (1) from moving out of the insulating component (4). This results in a sacrificial anode of this type that can be reliably operated over its entire service life.

30 Claims, 2 Drawing Sheets

SACRIFICIAL ANODE FOR CATHODIC CORROSION PROTECTION

CROSS REFERENCES TO RELATED APPLICATIONS

This application claims priority to German Patent Application No. DE 10 2006 025 252.7, filed May 29, 2006, entitled "SACRIFICIAL ANODE FOR CATHODIC CORROSION PROTECTION". This reference is expressly incorporated by reference herein, in its entirety.

BACKGROUND OF THE INVENTION

The invention pertains to a sacrificial anode for cathodic corrosion protection that comprises an anode body, a mounting component for mounting the sacrificial anode on the device to be protected, an insulating component that in certain areas surrounds the anode body and electrically insulates the anode body from the mounting component, and a resistive element that is inserted between the anode body and the mounting component, where the insulating component is fixed on the mounting component.

In practical applications, such a sacrificial anode is used, e.g., in water heaters. Water heaters heat water for private and industrial purposes. Such water heaters must meet high technical requirements. The systems should fulfill their functions over the longest possible service life without unfavorably influencing the quality of the water. They should be resistant to corrosion and therefore develop no leaks after several years of operation. These requirements must be fulfilled at water temperatures up to 100° C., where the water may have a broad quality spectrum with respect to various parameters such as water hardness, electric conductivity and salinity.

Plain carbon steel or low-alloy steel is normally used as the material for constructing water heaters for reasons of cost. In contact with water, this would lead to corrosion processes if oxygenated fresh water is continuously supplied such that corrosion damage to the water heater could be almost certainly expected after medium-term to long-term use. The inner side of the water heater is frequently provided with an enamel coating in order to prevent such corrosion damage or to reduce the extent of such corrosion damage. If such an enamel coating is properly applied, it is possible to achieve a coverage of 99.9% or more. However, at least minute defects always appear in the enamel such that the enamel coating cannot provide 100% protection against corrosion processes.

As an additional corrosion protection measure, enameled water heaters therefore are usually provided with a galvanic anode or an applied-current anode. These anodes are used as cathodic corrosion protection for the steel construction material in the region of enameling defects with electrolyte contact.

As an alternative to constructing water heaters of plain carbon steel or low-alloy steel, they could also be made of stainless steel. Variations consisting of stainless steel are usually very expensive and particularly sensitive to pitting and stress cracking in the presence of higher chloride concentrations. The use of cathodic corrosion protection measures is usually also very helpful in such instances.

If the anodes used consist of so-called sacrificial anodes, i.e., self-consuming anodes that do not require current from an external source, the anodes of choice are frequently sacrificial magnesium anodes. If the weight of such a sacrificial magnesium anode is on the order of 200-250 g/m$^2$ of enameled surface to be protected, the expected service life of a sacrificial magnesium anode will be at least two years if the enameling is applied with the coverage greater than 99.9%. This means that it is necessary to replace sacrificial anodes from time to time. Consequently, it would be desirable for the user to have the longest anode service life possible.

An anode can be used for cathodic corrosion protection as long as it can deliver a protective current. The time during which a protective current is delivered represents a function of the current capacity "stored" in the sacrificial anode. A reduction in current delivery can be realized, e.g., by inserting an ohmic resistance between the anode body and the device to be protected, and results in an extended service life. However at the same time, this lowers the electrochemical polarization, which is equivalent to a diminished protective effect. These two contradictory effects must be taken into consideration in applying the correct value for the ohmic resistance.

The utilization of conventional carbon film resistors or metal film resistors for achieving the above-described current limiting effect is known from U.S. Pat. No. 4,093,529 and U.S. Pat. No. 5,256,267. These publications respectively propose to equip the end of a sacrificial anode with an insulating sleeve of this type that is intended to ensure electrical insulation of the anode body from a mounting component that serves, e.g., for screwing the sacrificial anode into the wall of a water heater. The carbon film resistor or metal film resistor is then arranged between the anode body and the mounting component in order to extend the service life of the anode body as described above.

It is also known from this state of the art to realize the insulating component in such a way that it is pressed on one end of the anode body, and the anode body is subsequently held in the insulating component and therefore on the mounting component by means of a positive fit. However, this is associated with the problem that the anode body is consumed over time such that the positive fit between the anode body and the insulating sleeve may be lost. This may cause the anode body to separate from the remaining components, i.e., it may slide out of the insulating sleeve and fall into the water heater.

In light of these problems, the invention aims to disclose a sacrificial anode of this type that can be used for cathodic corrosion protection and ensures that reliable corrosion protection is maintained over the entire service life of the anode.

Based on the initially described sacrificial anode, this objective is realized in that a securing component is fixed on the anode body and prevents the anode body from moving out of the insulating component.

The invention therefore proposes that, in addition to any existing connection between the anode body and the insulating component, another component be provided, namely, the securing component that is fixed on the anode body in such a way that the anode body cannot separate from the insulating component.

Basically, the insulating component may be realized in different ways in order to ensure electrical insulation between the mounting component and the anode body. It is proposed according to an additional refinement of the invention that the insulating component be realized in the form of a sleeve that surrounds the anode body on one end. It is furthermore proposed according to a preferred additional refinement of the invention that the securing component be arranged and realized in such a way that it cannot be moved through the insulating component realized in the form of a sleeve in a state in which it is fixed on the anode body. According to another preferred refinement of the invention, this can be effected, specifically, by making the outside diameter of the securing component larger than the inside diameter of the insulating component in the form of a sleeve.

The securing component can also be fixed on the anode body in different ways. However, it is proposed according to a preferred additional refinement of the invention that the securing component be fixed on the anode body on the end on which the insulating component in the form of a sleeve surrounds the anode body. It is furthermore proposed according to a preferred additional refinement of the invention that the securing component be fixed on a core that extends through the anode body, preferably by means of welding, soldering and/or pressing.

The insulating component can be fixed on the mounting component in different ways, e.g., non-positively and/or positively. However, it is proposed according to a preferred additional refinement of the invention that the insulating component feature external threads for screwing into a mounting component provided with internal threads. This is advantageous because, here, a simple assembly of the sacrificial anode is thereby ensured.

Besides the securing component, typically, no fastening measures are required between the anode body and the insulating component. It is proposed according to an additional preferred refinement of the invention that a positive connection be produced between the anode body and the insulating component, preferably a positive connection in the form of a threaded connection.

It is furthermore proposed according to an additional preferred refinement of the invention that the above-described threaded connections of the sacrificial anode of the invention be additionally secured with an adhesive.

Basically, the resistive element may be realized in accordance with the state of the art. However, it is proposed according to an additional preferred refinement of the invention that the resistive element be realized in the form of a miniaturized circuit board of SMD (surface mounted device) design that has an ohmic resistor.

The mounting component may also be fixed to the device to be protected, e.g., a water heater, in different ways, for example, by means of a flanged connection. It is proposed according to an additional preferred refinement of the invention that the mounting component feature external threads for being screwed, e.g., into a wall of the device to be protected. In this case, it is preferred to provide an additional seal, for example, in the form of an annular seal in the region of the external threads.

Although a variety of materials may be considered for the anode body, it is proposed according to an additional preferred refinement of the invention that the anode body consist of a magnesium anode, preferably in the form of a pressed rod anode or in the form of a cast rod anode.

A preferred embodiment of the invention is described in greater detail below with reference to the drawings.

BRIEF SUMMARY

A sacrificial anode for cathodic corrosion protection that comprises an anode body (1), a mounting component (8) for mounting the sacrificial anode on the device to be protected, an insulating component (4) that in certain areas surrounds the anode body (1) and electrically insulates the anode body (1) from the mounting component (8), and a resistive element (9) that is inserted between the anode body (1) and the mounting component (8), where the insulating component (4) is fixed on the mounting component (8). According to the disclosure, a securing component (6) is fixed on the anode body (1) and prevents the anode body (1) from moving out of the insulating component (4). This results in a sacrificial anode of this type that can be reliably operated over its entire service life.

One object of the present disclosure is to describe an improved sacrificial anode for cathodic corrosion protection.

DETAILED DESCRIPTION

Figure 1:
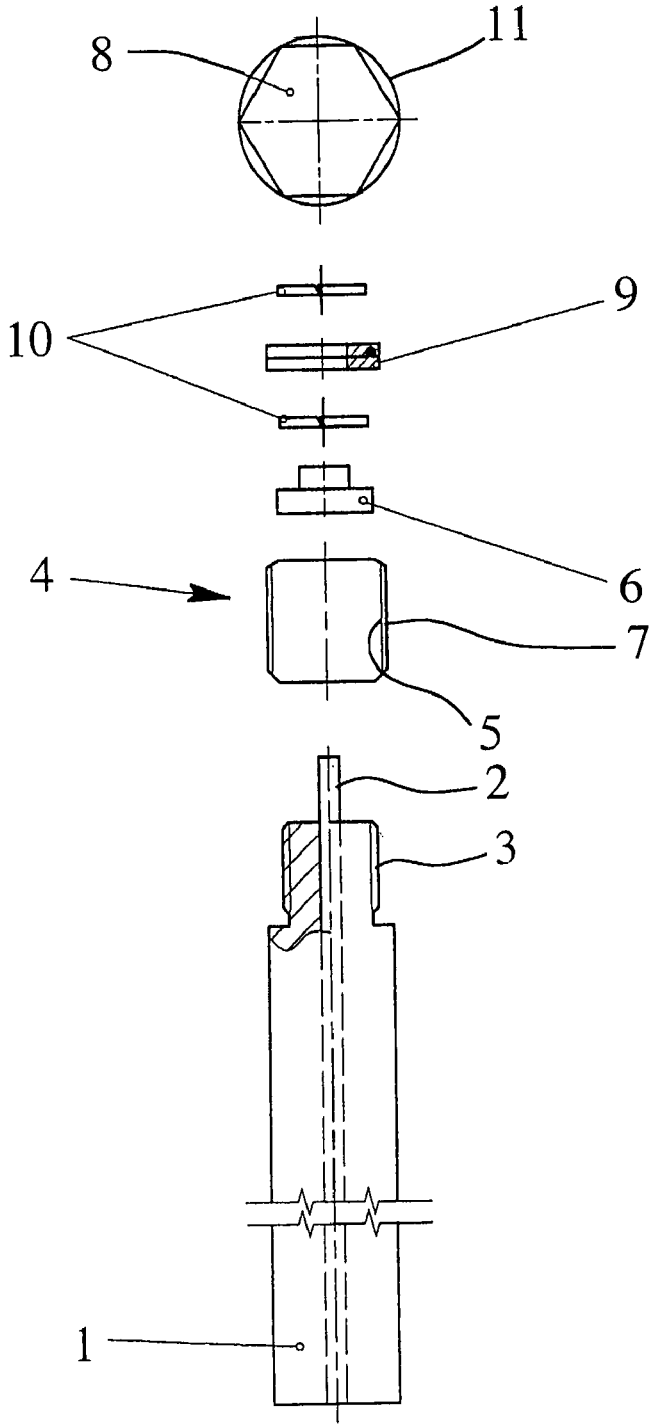
FIG. 1 is a partially sectioned sacrificial anode according to a preferred embodiment of the invention before assembly.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

FIG. 1 shows a preferred embodiment of a sacrificial anode according to the invention before assembly. The anode body 1 is realized in the form of a cast magnesium rod anode. A core 2 extending through the anode body 1 is exposed on the upper end of the anode body 1 by removing the anode material over a region of approximately 10 mm. In the region below, the anode body 1 has a smaller diameter than in its remaining regions, wherein external threads 3 are also provided in this region. An insulating component 4 in the form of a sleeve of a synthetic material, such as nylon, can be screwed onto these external threads 3, namely by means of internal threads 5 provided therein.

Before the assembly of the sacrificial anode according to the described preferred embodiment of the invention, a metallic securing component 6 is fixed on the core 2 of the anode body 1 after the insulating component 4 is screwed onto the external threads 3 of the anode body 1 and this threaded connection is additionally secured with a food-compatible adhesive. This can be realized, e.g., by means of a welding spot, a solder spot and/or pressing.

It is important that the outside diameter of the securing component 6 be larger than the inside diameter of the insulating component 4. This ensures that the anode body 1 can no longer separate from the insulating component 4. Since the insulating component 4 features not only internal threads 5, but also external threads 7 for being screwed into the mounting component 8 that is realized in the form of a screw plug and makes it possible to install the entire sacrificial anode according to the described preferred embodiment of the invention in the device to be protected, e.g., a water heater, the anode body 1 is secured from separating from the remaining components so that the anode body 1 is also prevented from falling into the water heater.

Figure 2:
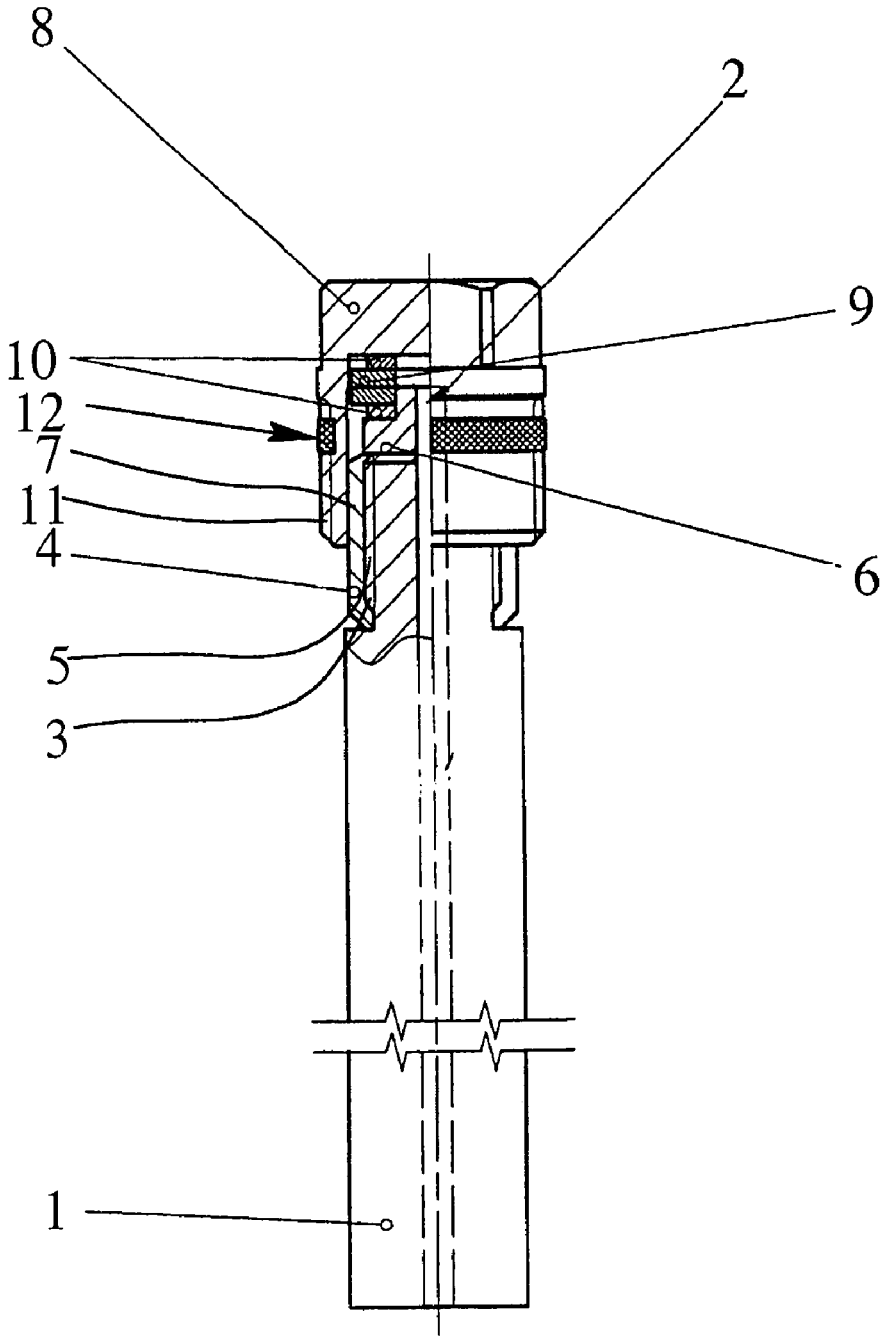
FIG. 2 is a partially sectioned sacrificial anode according to the preferred embodiment of the invention in the assembled state.

An ohmic resistance between the device to be protected and the anode body 1 is realized in this case by providing a resistive element 9 in the form of a miniaturized circuit board of SMD design that has an ohmic resistance of 62Ω, wherein said resistive element is elastically supported within the mounting component 8 by means of two surrounding flat springs 10 and in electrical contact with the securing component 6 and therefore also the anode body 1 via the core 2, as specifically illustrated in FIG. 2. Since the external threads 11 of the mounting component 9 are screwed into the (not-shown) device to be protected, a defined resistance between the anode body 1 and the device to be protected is realized by means of the resistive element 9 so as to extend the service life of the sacrificial anode. During the installation of the described sacrificial anode according to the preferred embodiment of the invention into the device to be protected, an annular seal 12 is also provided in the region of the external threads 10 of the mounting component 8 for sealing purposes.

This results in a sacrificial anode suitable for cathodic corrosion protection which has an extended service life and cannot separate from its mounted state on the device to be protected during its entire time of operation.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A sacrificial anode for cathodic corrosion protection, comprising an anode body (1), a mounting component (8) for mounting the sacrificial anode on the device to be protected, an insulating component (4) that in certain areas surrounds the anode body (1) and electrically insulates the anode body (1) from the mounting component (8), and a resistive element (9) that is inserted between the anode body (1) and the mounting component (8), wherein the insulating component (4) is fixed on the mounting component (8), characterized by the fact that a securing component (6) is fixed on the anode body (1) and prevents the anode body (1) from moving out of the insulating component (4), wherein said securing component includes an outside diameter and said insulating component defines an inside diameter, said outside diameter being larger than said inside diameter.

2. The sacrificial anode according to claim 1 wherein the insulating component (4) is constructed and arranged in the form of a sleeve that is made of an insulating material and surrounds the anode body (1) on one end.

3. The sacrificial anode according to claim 1 wherein the securing component (6) is fixed on the anode body (1) on an end on which the insulating component (4) in the form of a sleeve surrounds the anode body (1).

4. The sacrificial anode according to claim 3 wherein the securing component (6) is fixed on a core (2) that extends through the anode body (1).

5. The sacrificial anode according to claim 1 wherein the mounting component (8) includes external threads (10) for being screwed into the device to be protected.

6. The sacrificial anode according to claim 1 wherein the anode body (1) consists of a magnesium anode.

7. A sacrificial anode for cathodic corrosion protection, comprising an anode body (1), a mounting component (8) for mounting the sacrificial anode on the device to be protected, an insulating component (4) that in certain areas surrounds the anode body (1) and electrically insulates the anode body (1) from the mounting component (8), and a resistive element (9) that is inserted between the anode body (1) and the mounting component (8), wherein the insulating component (4) is fixed on the mounting component (8), characterized by the fact that a securing component (6) is fixed on the anode body (1) and prevents the anode body (1) from moving out of the insulating component (4), wherein the insulating component (4) features external threads (7) for being screwed into internal threads provided in the mounting component (8).

8. The sacrificial anode according to claim 7, wherein the insulating component (4) is constructed and arranged in the form of a sleeve that is made of an insulating material-and surrounds the anode body (1) on one end.

9. The sacrificial anode according to claim 8, wherein the securing component (6) is constructed and arranged such that it cannot be moved through the insulating component (4) in the form of a sleeve in the state in which it is fixed on the anode body (1).

10. The sacrificial anode according to claim 9, wherein said securing component includes an outside diameter and said insulating component defines and inside diameter, said outside diameter being larger than said inside diameter.

11. The sacrificial anode according to claim 7, wherein the securing component (6) is fixed on the anode body (1) on an end on which the insulating component (4) in the form of a sleeve, surrounds the anode body (1).

12. The sacrificial anode according to claim 11, wherein the securing component (6) is fixed on a core (2) that extends through the anode body (1).

13. The sacrificial anode according to claim 7, wherein the mounting component (8) includes external threads (10) for being screwed into the device to be protected.

14. The sacrificial anode according to claim 7, wherein the anode body (1) consists of a magnesium anode.

15. A sacrificial anode for cathodic corrosion protection, comprising an anode body (1), a mounting component (8) for mounting the sacrificial anode on the device to be protected, an insulating component (4) that in certain areas surrounds the anode body (1) and electrically insulates the anode body (1) from the mounting component (8), and a resistive element (9) that is inserted between the anode body (1) and the mounting component (8), wherein the insulating component (4) is fixed on the mounting component (8), characterized by the fact that a securing component (6) is fixed on the anode body (1) and prevents the anode body (1) from moving out of the insulating component (4), wherein a positive connection, preferably in the form of a threaded connection, is produced between the anode body (1) and the insulating component (4).

16. The sacrificial anode according to claim 15, wherein the insulating component (4) is constructed and arranged in the form of a sleeve that is made of an insulating material-and surrounds the anode body (1) on one end.

17. The sacrificial anode according to claim 16, wherein the securing component (6) is constructed and arranged such that it cannot be moved through the insulating component (4) in the form of a sleeve in the state in which it is fixed on the anode body (1).

18. The sacrificial anode according to claim 17, wherein said securing component includes an outside diameter and said insulating component defines and inside diameter, said outside diameter being larger than said inside diameter.

19. The sacrificial anode according to claim 15, wherein the securing component (6) is fixed on the anode body (1) on an end on which the insulating component (4) in the form of a sleeve surrounds the anode body (1).

20. The sacrificial anode according to claim 19, wherein the securing component (6) is fixed on a core (2) that extends through the anode body (1).

21. The sacrificial anode according to claim 15, wherein the mounting component (8) includes external threads (10) for being screwed into the device to be protected.

22. The sacrificial anode according to claim 15, wherein the anode body (1) consists of a magnesium anode.

23. A sacrificial anode for cathodic corrosion protection, comprising an anode body (1), a mounting component (8) for mounting the sacrificial anode on the device to be protected, an insulating component (4) that in certain areas surrounds the anode body (1) and electrically insulates the anode body (1) from the mounting component (8), and a resistive element (9) that is inserted between the anode body (1) and the mounting component (8), wherein the insulating component (4) is fixed on the mounting component (8), characterized by the fact that a securing component (6) is fixed on the anode body (1) and prevents the anode body (1) from moving out of the insulating component (4), wherein the resistive element (9) is constructed and arranged as a miniaturized circuit board with ohmic resistance.

24. The sacrificial anode according to claim 23, wherein the insulating component (4) is constructed and arranged in the form of a sleeve that is made of an insulating material-and surrounds the anode body (1) on one end.

25. The sacrificial anode according to claim 24, wherein the securing component (6) is constructed and arranged such that it cannot be moved through the insulating component (4) in the form of a sleeve in the state in which it is fixed on the anode body (1).

26. The sacrificial anode according to claim 25, wherein said securing component includes an outside diameter and said insulating component defines and inside diameter, said outside diameter being larger than said inside diameter.

27. The sacrificial anode according to claim 23, wherein the securing component (6) is fixed on the anode body (1) on an end on which the insulating component (4) in the form of a sleeve surrounds the anode body (1).

28. The sacrificial anode according to claim 27, wherein the securing component (6) is fixed on a core (2) that extends through the anode body (1).

29. The sacrificial anode according to claim 23, wherein the mounting component (8) includes external threads (10) for being screwed into the device to be protected.

30. The sacrificial anode according to claim 23, wherein the anode body (1) consists of a magnesium anode.

* * * * *